US010752857B2

(12) United States Patent
Garcia et al.

(10) Patent No.: US 10,752,857 B2
(45) Date of Patent: Aug. 25, 2020

(54) LUBRICATING COMPOSITION

(71) Applicant: SHELL OIL COMPANY, Houston, TX (US)

(72) Inventors: Jose Luis Garcia, Hamburg (DE); Stefan Gehle, Hamburg (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 16/311,815

(22) PCT Filed: Jun. 23, 2017

(86) PCT No.: PCT/EP2017/065594
§ 371 (c)(1),
(2) Date: Dec. 20, 2018

(87) PCT Pub. No.: WO2018/001908
PCT Pub. Date: Jan. 4, 2018

(65) Prior Publication Data

US 2019/0203141 A1 Jul. 4, 2019

(30) Foreign Application Priority Data

Jun. 28, 2016 (EP) ..... 16176710

(51) Int. Cl.
*C10M 111/02* (2006.01)
*C10M 111/00* (2006.01)

(52) U.S. Cl.
CPC ..... *C10M 111/02* (2013.01); *C10M 111/00* (2013.01); *C10M 2203/1006* (2013.01); *C10M 2203/1025* (2013.01); *C10M 2203/1085* (2013.01); *C10N 2220/022* (2013.01); *C10N 2230/02* (2013.01); *C10N 2230/04* (2013.01); *C10N 2230/40* (2013.01); *C10N 2240/102* (2013.01)

(58) Field of Classification Search
CPC .. C10M 2203/1006; C10M 2203/1025; C10M 2203/1085; C10N 2230/04; C10N 2220/022; C10N 2230/02
See application file for complete search history.

(56) References Cited

U.S. PATENT DOCUMENTS

2009/0111936 A1* 4/2009 Wedlock ..... C08K 5/01 524/551

FOREIGN PATENT DOCUMENTS

EP 1752514 A1 * 2/2007 ..... C10M 101/02

* cited by examiner

*Primary Examiner* — Vishal V Vasisth

(57) ABSTRACT

The present invention provides a lubricating composition suitable for use in a two-stroke crosshead diesel engine. The lubricating composition comprises a base oil blend consisting of base oil chosen from Group I, base oil chosen from Group II and deasphalted cylinder oil.

4 Claims, No Drawings

LUBRICATING COMPOSITION

PRIORITY CLAIM

The present application is the National Stage (§ 371) of International Application No. PCT/EP2017/065594, filed Jun. 23, 2017, which claims priority from EP Application 16176710.8, filed Jun. 28, 2016 incorporated herein by reference.

FIELD OF THE INVENTION

The present invention relates to a lubricating composition, in particular to a lubricating composition for use in internal combustion engines that may be operated under sustained high load conditions, such as marine diesel engines and power applications. More particularly, the present invention relates to a lubricating composition that can be used in a two-stroke crosshead diesel engine, particularly for slow speed or medium speed applications.

BACKGROUND OF THE INVENTION

Bright stock oil is a Group I base oil which has undergone solvent extraction, dewaxing and optionally a hydrogen treatment. It is commonly used as a base oil in lubricating oil compositions, in particular in lubricating oil compositions for marine and stationary low-speed crosshead diesel engines burning residual fuels with sulphur contents of up to 3.5 wt % and for trunk piston, medium-speed diesel engines operating on residual fuel in industrial and marine applications. However, as bright stock oil availability is becoming increasingly constrained within the market place, it is desirable to find alternative base oils for use in lubricating oil compositions for such applications.

EP 1752514 discloses that particular base oil blends comprising bright stock oil and de-asphalted cylinder oil (DACO) not only have no adverse effect on the lubricating properties of lubricating oil compositions, but also have advantageous viscometric properties in cylinder oil lubricants for use in cross-head engines and trunk piston engines. These lubricating compositions still comprise bright stock oil and it is desirable to further reduce the proportion of bright stock oil in lubricating compositions.

The present inventors have sought to provide lubricating composition suitable for use in two-stroke crosshead engines that contain even less bright stock oil, and preferably no bright stock oil. Preferably such lubricating compositions have advantageous properties such as reduced deposit formation.

SUMMARY OF INVENTION

The present inventors have surprisingly found that the Group I bright stock oil in lubricating compositions for use in two-stroke crosshead engines can be substituted with a combination of Group II base oils having a kinematic viscosity at 100° C. greater than 12 $mm^2/s$ and de-asphalted cylinder oil (DACO). The resulting lubricating compositions show reduced deposit formation compared to the formulations containing the bright stock oil.

Accordingly, the present invention provides a lubricating composition comprising a base oil blend and an additive package, wherein at least 90 wt % of the base oil blend, based upon the weight of the base oil blend, consists of:

(a) base oil chosen from Group I with a kinematic viscosity at 100° C. (according to ASTM D 445/446) of less than 20 $mm^2/s$;

(b) base oil chosen from Group II with a kinematic viscosity at 100° C. (according to ASTM D 445/446) of above 12 $mm^2/s$; and (c) deasphalted cylinder oil;

and wherein the lubricating composition has a kinematic viscosity at 100° C. (according to ASTM D 445/446) of above 12.5 $mm^2/s$ and below 30 $mm^2/s$.

The present invention further provides the use of such a lubricating composition in an internal combustion engine.

DETAILED DESCRIPTION OF THE INVENTION

The lubricating composition of the invention comprises a base oil blend and an additive package, and preferably the lubricating composition of the invention consists essentially of the base oil blend and the additive package. The term "base oil blend" is used to describe all the base oils that are present in the lubricating composition. It is not necessary that all the base oils are blended together before the addition of the additive package; all the base oils together are referred to as the "base oil blend" whether they were blended before or after addition of the additive package.

At least 90 wt % of the base oil blend, based upon the weight of the base oil blend, consists of:

(a) base oil chosen from Group I with a kinematic viscosity at 100° C. (according to ASTM D 445/446) of less than 20 $mm^2/s$;

(b) base oil chosen from Group II with a kinematic viscosity at 100° C. (according to ASTM D 445/446) of above 12 $mm^2/s$; and (c) de-asphalted cylinder oil.

Preferably at least 95 wt % of the base oil blend, based upon the weight of the base oil blend, consists of components (a), (b) and (c), more preferably at least 98 wt % and most preferably 100 wt %. In a preferred embodiment of the invention the base oil blend does not comprise bright stock oil.

The term 'bright stock' is used herein according to the standard definition in the art. A 'bright stock' oil is a high viscosity, fully refined and dewaxed lubrication oil produced from vacuum residuals. Such base oils will have a kinematic viscosity at 100° C. (according to ASTM D 445/446) of at least 22 $mm^2/s$.

The terms "Group I" and "Group II" are used to describe base oils according to the definitions of American Petroleum Institute (API) for categories I and II. These API categories are defined in API Publication 1509, 15th Edition, Appendix E, April 2002.

The base oil chosen from Group I suitably makes up at least 30 wt % of the base oil blend, based upon the weight of the base oil blend, more preferably at least 50 wt % and most preferably at least 60 wt %. The base oil chosen from Group I suitably makes up less than 94 wt % of the base oil blend, based upon the weight of the base oil blend, more preferably less than 85 wt % and most preferably less than 75 wt %. The base oil chosen from Group I may be a blend of different Group I base oils or may be a single Group I base oil. The kinematic viscosity at 100° C. (according to ASTM D 445/446) of the base oil chosen from Group I is less than 20 $mm^2/s$. The saturates content (according to ASTM D 2007) of the base oil chosen from Group I is preferably in the range of from 65 to 85 wt %. The aromatics content (according to ASTM D 2007) of the base oil chosen from Group I is preferably in the range of from 15 to 35 wt %. The amount of sulphur (according to ASTM D 4294) in the base oil chosen from Group I is preferably in the range of from 300 to 15,000 ppm.

The base oil chosen from Group II suitably makes up at least 10 wt % of the base oil blend, based upon the weight of the base oil blend, more preferably at least 15 wt % and most preferably at least 20 wt %. The base oil chosen from Group II suitably makes up less than 45 wt % of the base oil blend, based upon the weight of the base oil blend, more preferably less than 38 wt % and most preferably less than 32 wt %. The base oil chosen from Group II may be a blend of different Group II base oils or may be a single Group II base oil. The kinematic viscosity at 100° C. (according to ASTM D 445/446) of the base oil chosen from Group II is above 12 $mm^2/s$.

The de-asphalted cylinder oil suitably makes up at least 1 wt % of the base oil blend, based upon the weight of the base oil blend, more preferably at least 2 wt % and most preferably at least 3 wt %. The de-asphalted cylinder oil suitably makes up less than 15 wt % of the base oil blend, based upon the weight of the base oil blend, more preferably less than 10 wt % and most preferably less than 7 wt %. De-asphalted cylinder oil is the product of a de-asphalting process step wherein asphalt is removed from a reduced crude petroleum feed or from the residue of a vacuum distillation of a crude petroleum feed. The de-asphalting process uses a light hydrocarbon liquid solvent, e.g. propane, to remove asphalt compounds. De-asphalting processes are well known and are described, for example, in "Lubricant base oil and wax processing", Avilino Sequeira Jr, Marcel Dekker Inc., New York 1994, ISBN 0-8247-9256-4, pages 53-80.

The preferred amounts of the base oil chosen from Group I (suitably from 30 to 94 wt % of the base oil blend), the base oil chosen from Group II (suitably from 5 to 45 wt % of the base oil blend) and the de-asphalted cylinder oil (suitably from 1 to 15 wt % of the base oil blend) are suitable for providing a lubricating composition having the required viscosity and also the required solvency. By solvency is meant the ability of the lubricating composition to dissolve polar species such as polar contaminants and polar additives. If the solvency of the lubricating composition is too low this can lead to deposit formation. Typically Group II base oils have low solvency as their aromatic content is low. The Group I base oils and DACO typically have higher aromatic content and therefore the combination of Group I, Group II and DACO can have desirable solvency properties.

The base oil blend preferably makes up from 60 to 99 wt % of the lubricating composition based upon the total weight of the lubricating composition, more preferably from 65 to 98 wt % and most preferably from 70 to 95 wt %.

The term "additive package" is used to describe all the additives that are present in the lubricating composition. It is not necessary that all the additives are combined together into an additive package before addition to the base oil blend; all the additives are together are referred to as the "additive package" whether they were combined together before or after addition to the base oil blend.

The additive package consists of additives typically used in lubricating compositions and preferably consists of additives typically used in lubricating compositions for use in two-stroke crosshead engines. The lubricating composition typically comprises one or more other additives chosen from detergents, anti-oxidants, anti-wear additives, dispersants, extreme pressure additives, friction modifiers, viscosity modifiers, pour point depressants, metal passivators, corrosion inhibitors, demulsifiers, anti-foam agents and seal compatibility agents.

Preferably the additive package makes up less than 60 wt % of the lubricating composition based upon the total weight of the lubricating composition, more preferably less than 50 wt %, most preferably less than 40 wt %. Having a higher amount of additive package is undesirable as it may be difficult to dissolve all the additives in the base oil blend and this can lead to deposit formation.

In a preferred embodiment of the invention the lubricating composition consists of the base oil blend and the additive package.

The lubricating composition has a kinematic viscosity at 100° C. (according to ASTM D 445/446) of above 12.5 $mm^2/s$ and below 30 $mm^2/s$. The preferred SAE grades are SAE 40 (having a viscosity from 12.5 to less than 16.3 $mm^2/s$), SAE 50 (having a viscosity from 16.3 to less than 21.9 $mm^2/s$) and SAE 60 (having a viscosity from 21.9 to less than 26.1 $mm^2/s$). Preferably the lubricating composition has a kinematic viscosity at 100° C. (according to ASTM D 445/446) of from 16.3 to 26.1 $mm^2/s$, more preferably of from 19 to 26.1 $mm^2/s$.

The lubricating composition preferably has a Base Number (as measured by ISO 3771) of 100 mg KOH/g or less, more preferably 70 mg KOH/g or less. The Base Number of the lubricating composition is affected by the detergents that may be present in the additive package of the lubricating composition. The skilled person can choose appropriate detergents and quantities of detergents to achieve the required Base Number. The detergents may include oil-soluble neutral and over-based sulphonates, phenates, sulphurised phenates, thiophosphonates, salicylates and naphthenates and other oil-soluble carboxylates of a metal, particularly the alkali or alkaline earth metals, e.g. sodium, potassium, lithium, and in particular calcium and magnesium. Preferred metal detergents are neutral and over-based detergents having a Base Number (according to ISO 3771) of up to 450 mg KOH/g.

The preferred viscosity index of the lubricating composition (as measured by ISO 2909) is preferably greater than 90, more preferably greater than 95.

The lubricating compositions of the present invention may be conveniently prepared by admixing the additives that make up the additive package with the base oils that make up the base oil blend.

The present invention further provides the use of a lubricating composition according to the invention in an internal combustion engine. The internal combustion engine is suitably an engine operated under sustained high load conditions, such as marine diesel engines and power applications. Such engines may sometimes experience low load conditions. The internal combustion engine is preferably a two-stroke crosshead diesel engine.

The present invention is described below with reference to the following Examples, which are not intended to limit the scope of the present invention in any way.

EXAMPLES

Lubricating Oil Compositions

Four lubricating compositions were tested. Comparative example 1 was a reference composition, whereas example 1 and example 2 were compositions according to the invention. The components and properties of the compositions are shown in Table 1 below.

The compositions all contained a Group I base oil (HVI 160S available from Shell). Comparative example 1 contained Bright Stock Extract (HVI 650 available from Shell) whereas examples 1 and 2 contained deasphalted cylinder oil (Flavex 595 available from Shell) and a blend of Group II base oils (SK 120 BS available from SK Lubricants). The compositions of example 1 and 2 were essentially the same.

Comparative example 1 contained additive package 1 which is a marine cylinder lubricant additive package containing conventional detergents and dispersant. Examples 1 and 2 contained additive package 2 which is another marine cylinder lubricant additive package containing conventional detergents and dispersants. Although the two additive packages are different, the inventors do not think this difference will have a significant effect on the wear and deposit formation properties.

Testing

The Base Number of each formulation was measured by ISO 3771. The kinematic viscosities at 100° C. and 40° C. were measured by ASTM D 445/446. The viscosity index was measured by ISO 2909.

The deposit formation control properties of the lubricating compositions of the present invention were tested using a modified Wolf Strip test procedure (according to obsolete DN 51392). The method determines the tendency towards formation of deposits on a test strip of the Wolf Strip Test Apparatus caused by oxidative and thermal exposure. The test oil is blended with 2% Heavy Fuel Oil and homogenised at 60° C. A 150 ml sample of the blended oil is pumped in the form of a thin film for 12 hours at a flow rate of 50±5 ml/h over a removable metal test strip. The test strip is heated to 280° C. It is inclined at an angle of 8° to the horizontal. The sample drops from the test strip into the not heated oil reservoir and is returned to the test strip by a small piston pump. At the end of the test the metal strip and deposits formed are washed in solvent and weighed.

A Bolnes 3 (1) DNL 170/600 engine test was used to assess the deposit reduction properties and also the wear protection provided by the lubricating compositions. The details of this test are disclosed on pages 7-10 of "Cylinder Lubrication—Utilising the latest findings on Low Speed 2-Stroke Diesel engine oil stress from field and laboratory engine testing in the development of a Wide Range Cylinder Lubricant Shell Alexia S4", Paper no. 84, CIMAC Congress 2013, Shanghai. Two different sets of conditions were used during the testing, and this is expressed as Bolnes Engine test (1) and (2) in Table 1.

TABLE 1

| | | Comparative Example 1 | Comparative Example 2 | Example 1 | Example 2 |
|---|---|---|---|---|---|
| | Group I Base Oil (HVI 160S) | 57.6 | 50 | 51 | 51 |
| | Bright Stock Extract (HVI 650) | 15 | 4 | | |
| | Base Oil Blend (Group II) | | 20 | 20 | 20 |
| | Deasphalted cylinder oil | | | 3 | 3 |
| | Additive package 1 | 27.4 | | | |
| | Additive package 2 | | 26 | 26 | 26 |
| | TBN value in mg KOH/g | 69.15 | 69.23 | 68.82 | 69.42 |
| | Kinematic viscosity at 100° C. in cSt or $mm^2/s$ | 19.39 | 19.55 | 19.12 | 19.39 |
| | Kinematic viscosity at 40° C. in cSt or $mm^2/s$ | 225.4 | 221.9 | 218 | 221.7 |
| | Viscosity Index | 98 | 100 | 99 | 99 |
| Modified | Δ weight 1 in mg | 144.3 | 115.9 | | 94.5 |
| Wolf Strip | Δ weight 1 in mg | 139.7 | 147.9 | | 167.4 |
| Test | Deposits (sum Δ, in mg) | 284 | 263.8 | | 261.9 |
| Bolnes | Total Piston Ring Weight | 10.41 | | 8.05 | |
| Engine | Loss in g | | | | |
| Test (1) | Piston Ring Average Wear in mm | 0.10 | | 0.08 | |
| | Total Piston Rating (unweighted demerits) | 227.92 | | 214.26 | |
| Bolnes | Total Piston Ring Weight | 7.57 | 9.39 | | |
| Engine | Loss in g | | | | |
| Test (2) | Piston Ring Average Wear in mm | 0.08 | 0.10 | | |
| | Total Piston Rating (unweighted demerits) | 199.08 | 211.10 | | |

Example 1, a lubricating composition according to the invention, exhibits improved results in the Bolnes Engine Test compared to Comparative Example 1, showing reduced Total Piston Weight Loss and a better Total Piston Rating. The Piston Ring Average Wear is roughly the same for Example 1 and Comparative Example 1. Comparative Example 2 (which contains Group I and Group II base oils but no DACO) gives slightly worse results in a Bolnes Engine Test compared to Comparative Example 1.

Example 2, a lubricating composition according to the invention, exhibits improved results in the Modified Wolf Strip Test compared to Comparative Example 1, showing reduced deposits, and shows a slightly improved result compared to Comparative Example 2. The Examples show that replacing the Bright Stock Extract with Group II base oil and DACO provides a lubricating composition with reduced deposit formation.

That which is claimed is:

1. A lubricating composition comprising a base oil blend and an additive package, wherein at least 90 wt % of the base oil blend, based upon the weight of the base oil blend, consists of:

(a) base oil chosen from Group I with a kinematic viscosity at 100° C. (according to ASTM D 445/446) of less than 20 $mm^2/s$, wherein the base oil chosen from Group I makes up at least 30 wt % and less than 94 wt % of the base oil blend, based upon the weight of the base oil blend;

(b) base oil chosen from Group II with a kinematic viscosity at 100° C. (according to ASTM D 445/446) of above 12 $mm^2/s$, wherein the base oil chosen from Group II makes up at least 5 wt % and less than 45 wt % of the base oil blend, based upon the weight of the base oil blend; and (c) deasphalted cylinder oil, wherein the de-asphalted cylinder oil makes up at least 1 wt % and less than 15 wt % of the base oil blend, based upon the weight of the base oil blend; and wherein the lubricating composition has a kinematic viscosity at 100° C. (according to ASTM D 445/446) of above 12.5 $mm^2/s$ and below 30 $mm^2/s$.

2. The lubricating composition according to claim 1, wherein the additive package makes up less than 60 wt % of the lubricating composition, based upon the weight of the lubricating composition.

3. The lubricating composition according to claim 1 in an internal combustion engine.

4. The lubricating composition according to claim 3, wherein the internal combustion engine is a two-stroke crosshead diesel engine.

* * * * *